US011245219B2

(12) United States Patent
Shimizu et al.

(10) Patent No.: US 11,245,219 B2
(45) Date of Patent: Feb. 8, 2022

(54) JOINT CONNECTOR

(71) Applicant: Yazaki Corporation, Tokyo (JP)

(72) Inventors: Tomohiko Shimizu, Makinohara (JP); Tadashi Hasegawa, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/891,529

(22) Filed: Jun. 3, 2020

(65) Prior Publication Data

US 2020/0388948 A1 Dec. 10, 2020

(30) Foreign Application Priority Data

Jun. 6, 2019 (JP) ..... JP2019-106305

(51) Int. Cl.
*H01R 13/52* (2006.01)
*H01R 13/436* (2006.01)

(52) U.S. Cl.
CPC ..... *H01R 13/4364* (2013.01)

(58) Field of Classification Search
CPC ..... H01R 13/4364; H01R 31/08; H01R 13/4367; H01R 13/506; H01R 13/424
USPC ..... 439/345
See application file for complete search history.

(56) References Cited

U.S. PATENT DOCUMENTS

2003/0040224 A1* 2/2003 Fujii ..... H01R 31/085 439/638
2004/0115973 A1* 6/2004 Fujii ..... H01R 4/64 439/97
2013/0303023 A1 11/2013 Miwa et al.
2014/0120759 A1* 5/2014 Suzuki ..... H01R 13/4223 439/345
2015/0340790 A1* 11/2015 Hamai ..... H01R 31/08 439/660
2016/0064852 A1* 3/2016 Saitoh ..... H01R 13/5202 439/626
2018/0351302 A1* 12/2018 Urashima ..... H01R 13/518
2019/0109417 A1* 4/2019 Tsukamoto ..... H01R 13/7193
2020/0227859 A1* 7/2020 Nobukuni ..... H01R 13/506
2020/0373704 A1* 11/2020 Shimizu ..... H01R 13/516

FOREIGN PATENT DOCUMENTS

CN 103119799 A 5/2013
EP 2 696 444 A1 2/2014
JP 2012-9325 A 1/2012
JP 2013-012437 A 10/2013
WO 2012039510 A1 3/2012

* cited by examiner

*Primary Examiner* — Abdullah A Riyami
*Assistant Examiner* — Nelson R. Burgos-Guntin
(74) *Attorney, Agent, or Firm* — Sughrue Mion, PLLC

(57) ABSTRACT

A joint connector, including: a connector housing; a joint terminal; a terminal holder; and a lock arm that is formed in an outer peripheral wall of the connector housing, in which a rear end portion of the terminal holder is provided with convex portions that protrude rearward from a rearmost end edge of the connector housing in a proper assembled state of the terminal holder with respect to the connector housing.

3 Claims, 16 Drawing Sheets

JOINT CONNECTOR

CROSS REFERENCE TO RELATED APPLICATIONS

This application is based on and claims priority from Japanese patent application No. 2019-106305 filed on Jun. 6, 2019, the entire contents of which are incorporated herein by reference.

BACKGROUND OF THE INVENTION

1. Technical Field

The present invention relates to a joint connector having a configuration in which a terminal holder holding a joint terminal is fitted to a rear-end inner portion of a connector housing.

2. Background Art

FIG. 12 illustrates an example of a joint connector in the related art, which is described in Patent document 1.

A joint connector 101 includes a connector housing (outer housing) 110 and a joint terminal unit 120. The joint terminal unit 120 includes a terminal holder (inner housing) 121, a joint terminal 130, and a ferrite plate 138. The joint connector 101 is configured by fitting the joint terminal unit 120, which is assembled in advance, to an inner portion of the connector housing 110 from a rear side, and in the assembled state, each electrical contact portion 131 of the joint terminal 130 is held in electrical contact with a mating terminal at the inner portion of the connector housing 110. The joint terminal 130 short-circuits a plurality of necessary mating terminals by bringing the electrical contact portion 131 into electrical contact with the mating terminal.

In order to join the connector housing 110 with the joint terminal unit 120 in an assembled state, a cantilevered lock arm 15 is provided in an outer peripheral wall 111 of the connector housing 110, and a locking portion 129 is provided on the terminal holder 121. When the joint terminal unit 120 is fitted to the connector housing 110 from the rear side, the lock arm 115 of the connector housing 110 is engaged with the locking portion 129 of the terminal holder 121. Accordingly, the joint terminal unit 120 is locked to the connector housing 110.

In a state where the locking is established, as illustrated in FIG. 13, the terminal holder 121 of the joint terminal unit 120 is almost completely hidden at the inner portion of the connector housing 110.

PATENT DOCUMENTS

[Patent document 1] JP-A-2012-9325

SUMMARY

In a case where the joint connector 101 is dropped to a floor surface at the time of being handled, with a rear end side thereof facing downward, a rear end edge of the connector housing 110 which is located at a rearmost end impacts onto the floor surface, and thus the impact is directly applied to the cantilevered lock arm 115. As a result, the lock arm 115 may be damaged when an excessive load acts on the lock arm 115, and the assembled state of the joint terminal unit 120 may not be normal.

The invention has been made in view of the above circumstance, and an object of the invention is to provide a joint connector, which can prevent an excessive impact from being applied to a lock portion between a connector housing and a terminal holder even when dropping onto a floor surface with a rear end side thereof facing downward, so that an abnormality does not occur in the assembled state as a result.

In order to achieve the above object, the joint connector according to the present invention is characterized by the following (1) to (3).

(1) A joint connector, comprising:

a connector housing in which an inner space at a front portion thereof in an axial direction is secured as a connection space with a mating terminal;

a joint terminal that is accommodated in an inner portion of the connector housing, and that locates an electrical contact portion to be connected with the mating terminal in the connection space;

a terminal holder that is fitted into a rear-end inner portion of the connector housing while holding the joint terminal; and a lock arm that is formed in an outer peripheral wall of the connector housing, and engages with a locking portion provided on the terminal holder when the terminal holder is properly fitted into the rear-end inner portion of the connector housing, to lock the terminal holder with respect to the connector housing, wherein the lock arm is connected to the outer peripheral wall of the connector housing at a front end thereof and extends rearward in a cantilever manner, and includes a lock beak on an inner side surface of a free end thereof, and when the terminal holder is fitted into the rear-end inner portion of the connector housing, the lock beak fits in a position on a rear side of the locking portion, and locking with respect to the locking portion is established, and a rear end portion of the terminal holder is provided with convex portions that protrude rearward from a rearmost end edge of the connector housing in a proper assembled state of the terminal holder with respect to the connector housing.

(2) The joint connector according to above (1), wherein a pair of the lock arms are provided on side wall portions facing each other of the outer peripheral wall of the connector housing having a rectangular shape in a rear view, and the convex portions are respectively disposed at positions near four corners of a rectangular rear end surface of the terminal holder, that is, at positions in the vicinity of the lock arms.

(3) The joint connector according to above (2), wherein the rectangular rear end surface of the terminal holder is formed in a concave shape, recessed in an arch shape in a side view, and the convex portions are disposed at the four corners of the concave-shaped rear end surface respectively.

According to the joint connector having the configuration (1) described above, when the joint connector drops with a rear end side thereof facing downward to impact on a floor surface, what first comes into contact with the floor surface is not the connector housing having the lock arm, but the convex portions provided on the rear end surface of the terminal holder. Therefore, the impact of dropping is first applied to the terminal holder and then transmitted to the connector housing. Here, since the lock beak of the lock arm provided in the connector housing is engaged with the locking portion at the position on the rear side of the locking portion of the terminal holder, an action in a direction in which a surface pressure is reduced, instead of an action in a direction in which the surface pressure is increased, is exerted on an abutting surface between the lock beak and the locking portion. Therefore, an excessive load does not act on the lock portion, damage of the lock arm can be avoided, and the possibility that the assembled state is not normal due to the damage of the lock arm is eliminated.

It is also conceivable to attach a rear cover to a rear end portion of the joint connector so that the impact at the time of dropping is not applied to the lock arm. However, in this case, an extra component is added, which hinders reduction in size and weight. In this respect, in the joint connector described above, since the lock arm can be protected without using an extra component such as a rear cover, it is possible to avoid an increase in the number of components and to contribute to reduction in size and weight.

According to the joint connector having the configuration (2) described above, since the convex portions that first impact on the floor surface are disposed at positions near the four corners of the rectangular rear end surface of the terminal holder, that is, at positions in the vicinity of the lock arms, the lock arms can be protected from the impact more reliably by the convex portions. In addition, since the convex portions are formed only at specific positions, the increase in size and weight can also be minimized.

According to the joint connector having the configuration of (3) described above, since the rectangular rear end surface of the terminal holder is formed in a concave shape, recessed in an arch shape in a side view, and the convex portions are disposed at the four corners of the concave-shaped rear end surface respectively, the lock arm can be protected from the impact and the increase in size and weight can be minimized.

According to the invention, even when the joint connector drops onto a floor surface with a rear end side thereof facing downward, an excessive impact can be prevented from being applied to a lock portion between a connector housing and a terminal holder. As a result, an appropriate assembled state can be maintained.

The invention has been briefly described above. Further, details of the invention will be clarified by reading a mode for carrying out the invention (hereinafter, referred to as "embodiments") described below with reference to the accompanying drawings.

BRIEF DESCRIPTION OF THE DRAWINGS

FIGS. 6A and 6B are configuration diagrams of the joint connector, in which FIG. 6A is an exploded perspective view thereof, and FIG. 6B is a perspective view of the joint connector in an assembled state.

FIGS. 7A and 7B are perspective views of the joint connector that is vertically cut, in which FIG. 7A is an exploded perspective view thereof, and FIG. 7B illustrates a perspective view of the joint connector in an assembled state and a state of the joint connector impacting on a floor surface in a case of dropping to the floor surface.

FIGS. 8A and 8B are diagrams schematically illustrating a position at which an impact transmits when a joint connector drops onto a floor surface with a rear end side thereof facing downward, in which FIG. 8A is a diagram illustrating a state where a load from the floor surface is applied to a convex portion at the time of dropping in a case of the joint connector according to the embodiment of the invention, and FIG. 8B is a diagram illustrating a state where the load from the floor surface is applied at the time of dropping in a case of a joint connector having no convex portion.

FIGS. 14A and 14B are diagrams illustrating a configuration of a joint connector (a type with a rear cover) serving as a comparative example with respect to the joint connector according to the embodiment of the invention, in which FIG. 14A is an exploded perspective view thereof, and FIG. 14B is a perspective view of the joint connector in an assembled state.

FIGS. 15A and 15B are perspective views of the joint connector illustrated in FIGS. 14A and 14B which are vertically cut, in which FIG. 15A is an exploded perspective view thereof, and FIG. 15B illustrates a perspective view of the joint connector in an assembled state and a state of the joint connector impacting on a floor surface in a case of dropping to the floor surface.

DETAILED DESCRIPTION OF EMBODIMENTS

A specific embodiment according to the invention will be described below with reference to the drawings.

A connector according to the present embodiment is a joint connector in which a joint terminal that contacts a mating terminal to short-circuit a plurality of mating terminals is accommodated at an inner portion of a connector housing. The joint connector may be, for example, fixed to a wire harness by tape winding in a using state, as will be described below.

Figure 1:
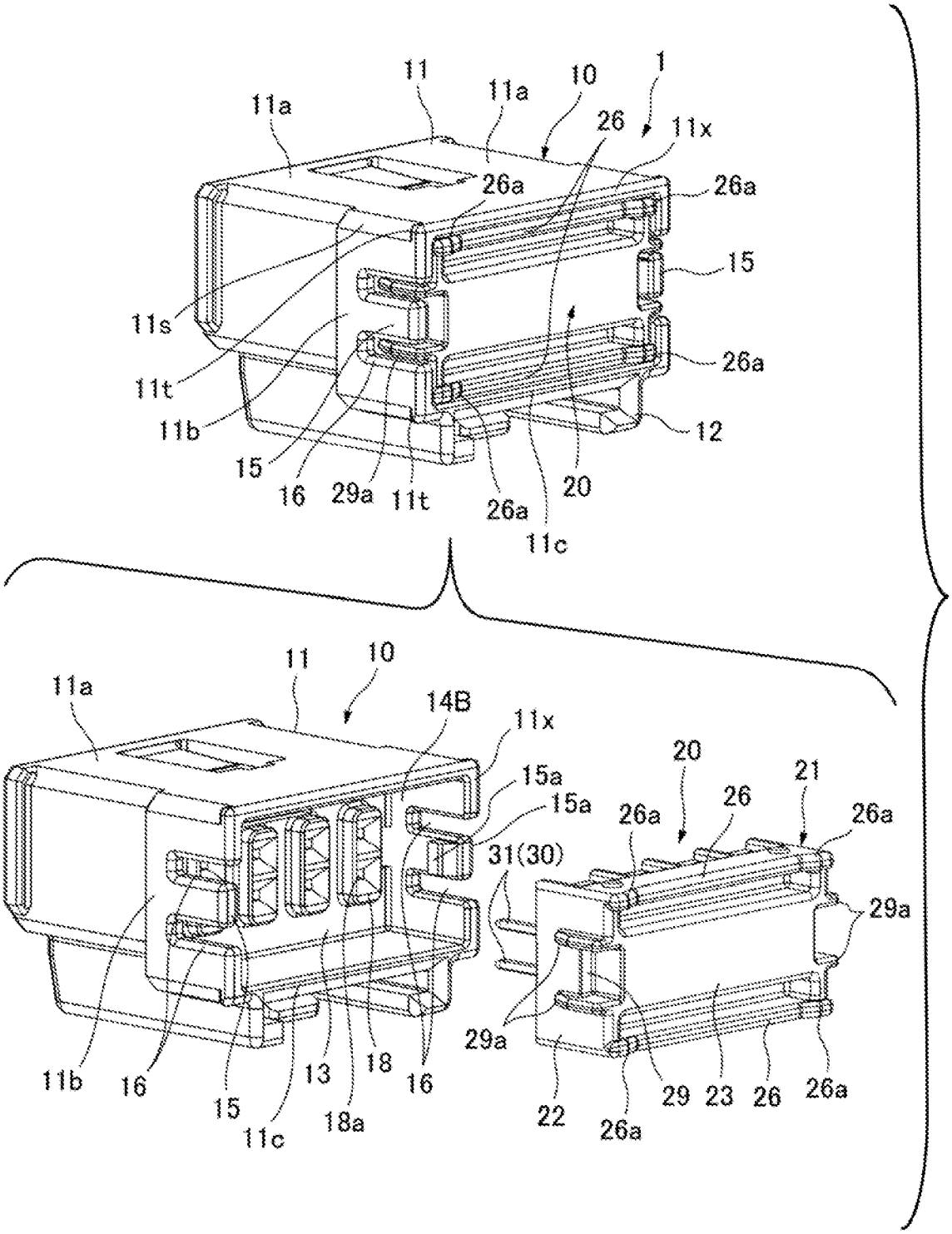
FIG. 1 illustrates a perspective view and an exploded perspective view of a joint connector as viewed from behind according to an embodiment of the invention.
Figure 2:
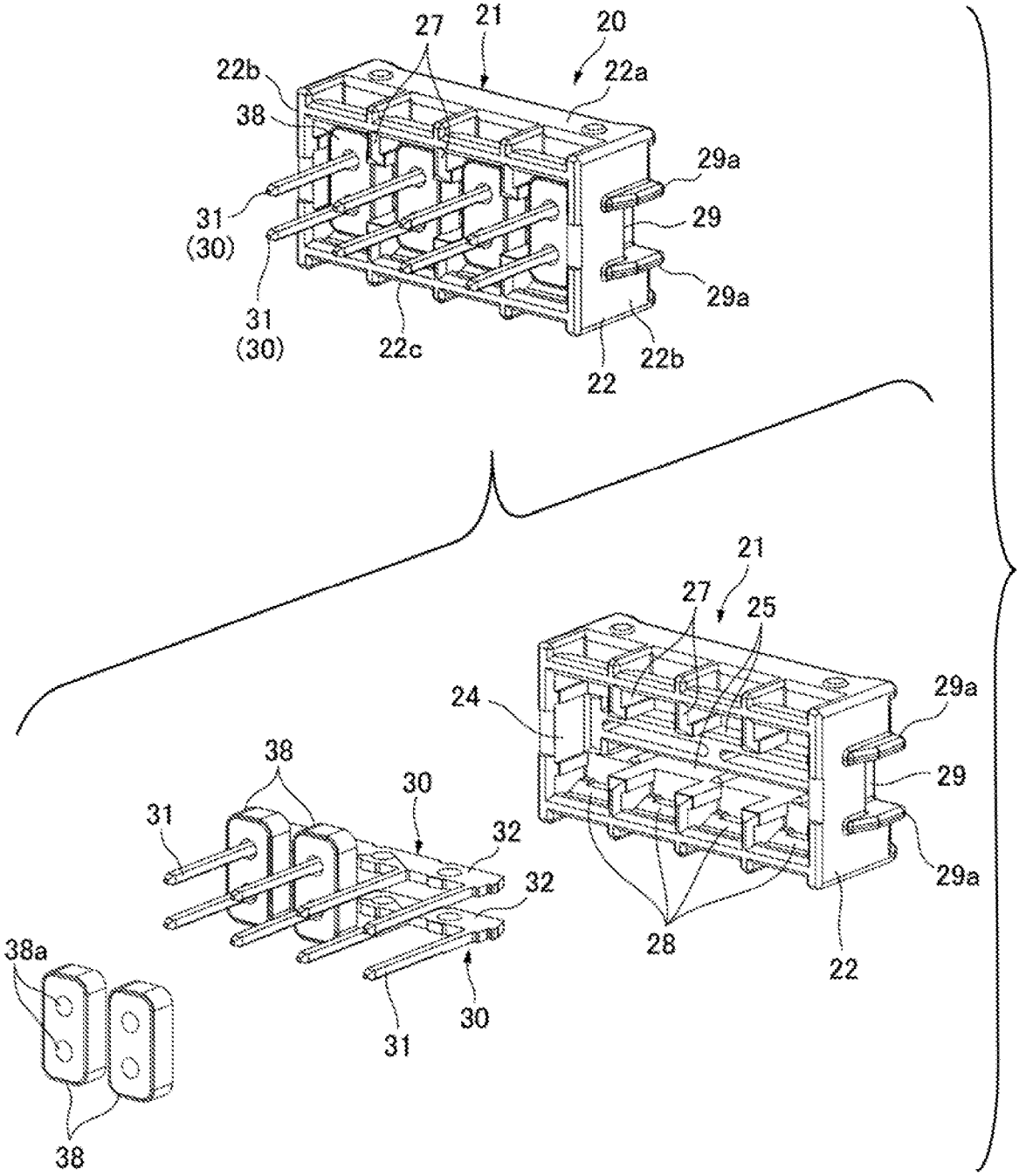
FIG. 2 illustrates a perspective view and an exploded perspective view of a joint terminal unit, which is a component of the joint connector, as viewed from the front.
Figure 3:
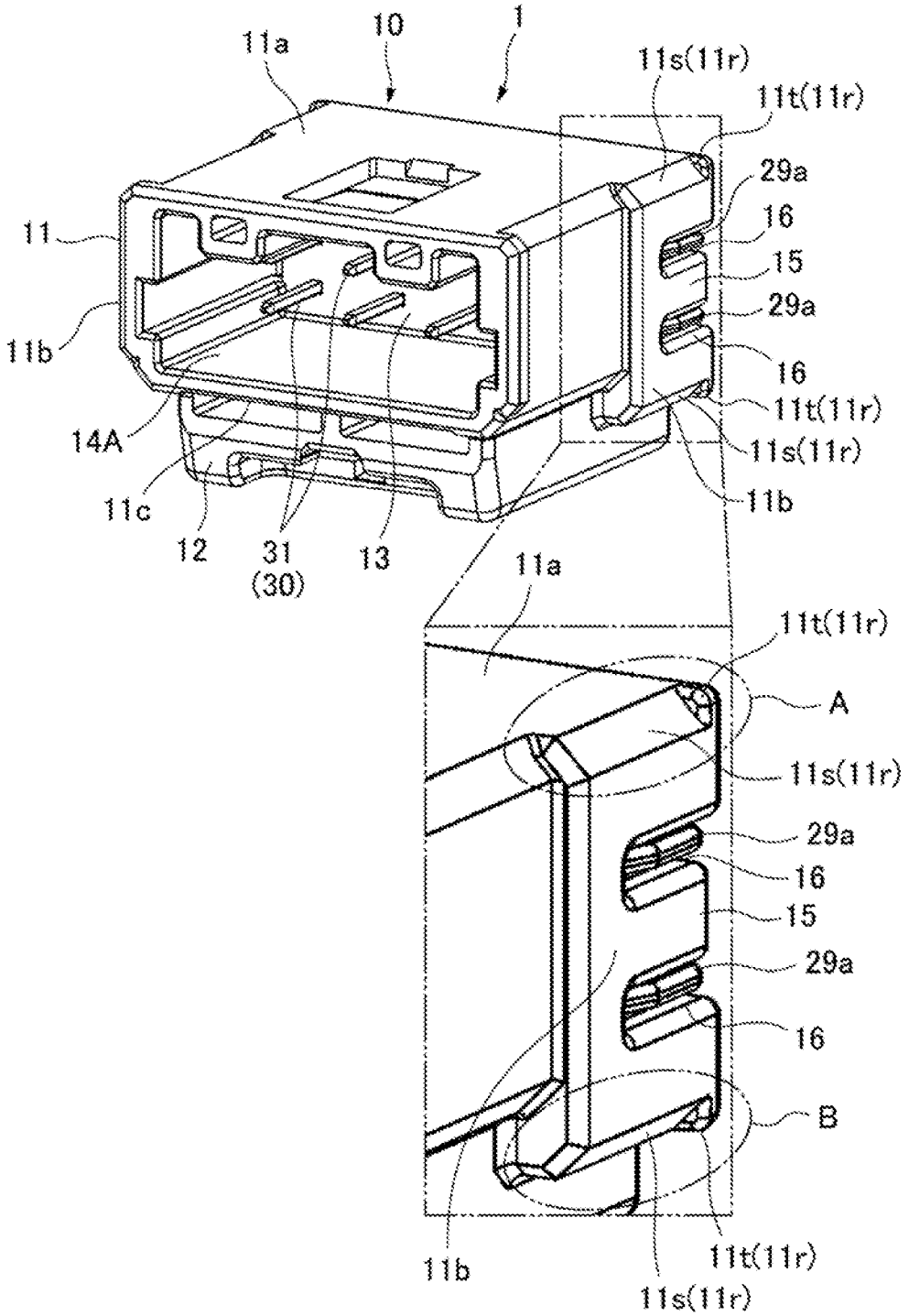
FIG. 3 illustrates a perspective view of the joint connector as viewed from the front, and a partial enlarged view thereof.
Figure 4:
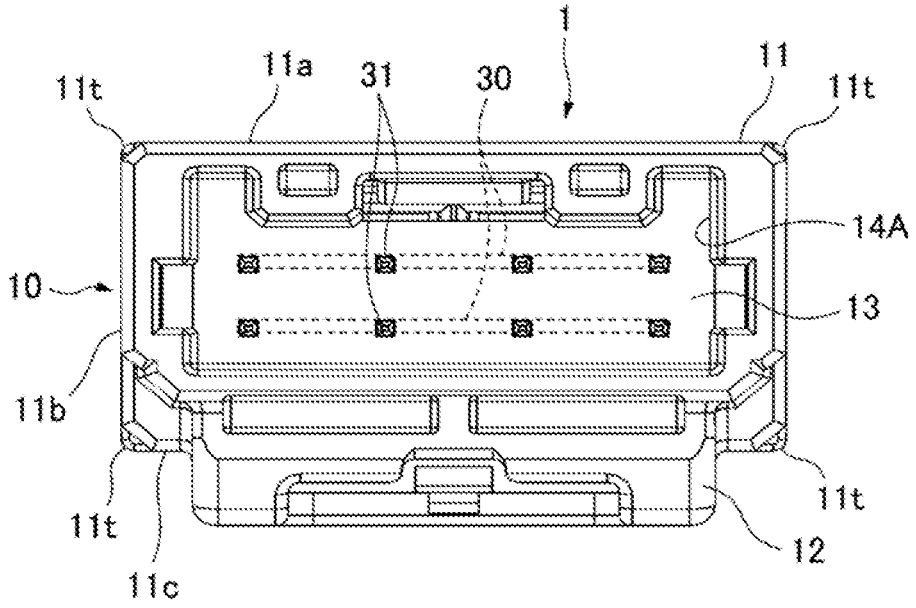
FIG. 4 is a front view of the joint connector.
Figure 5:
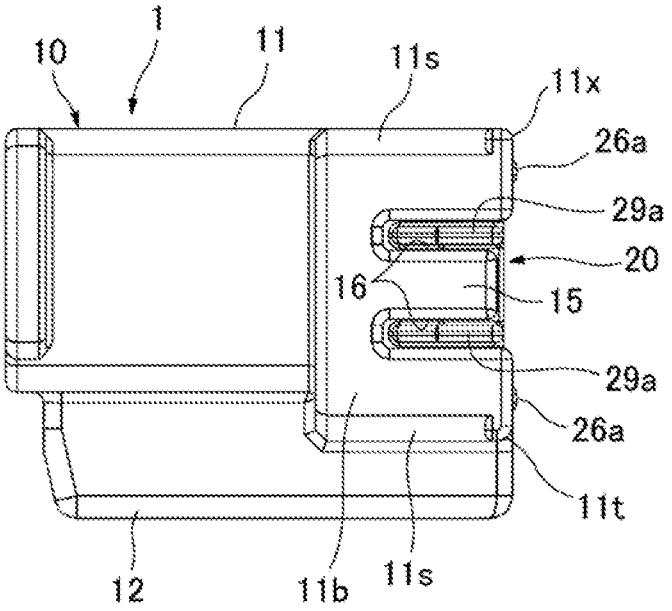
FIG. 5 is a side view of the joint connector.
Figure 6A:
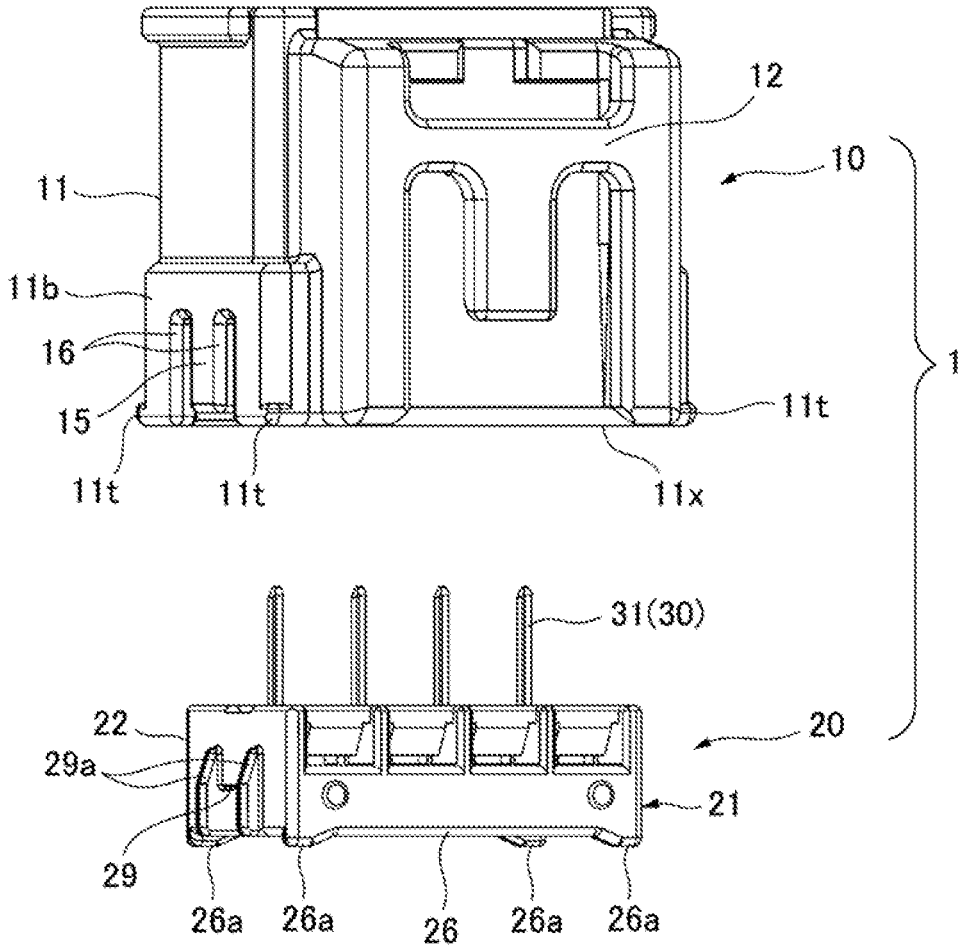
Figure 6B:
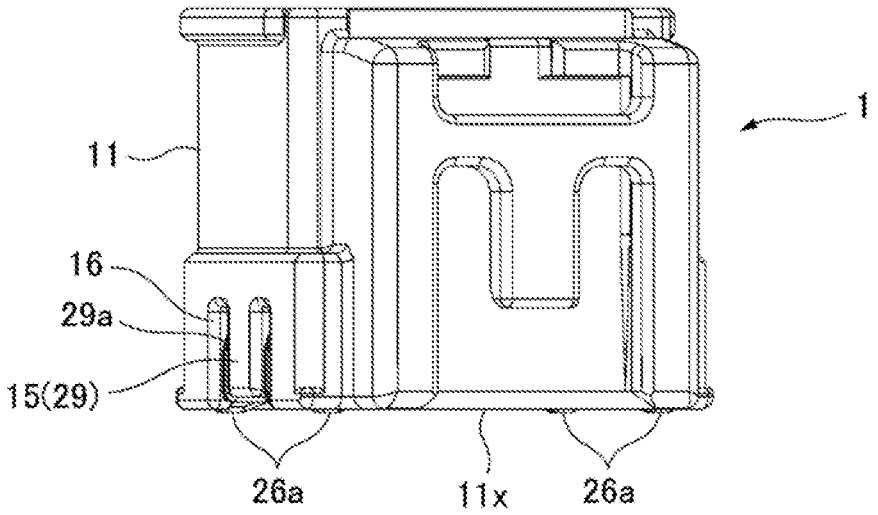
Figure 7A:
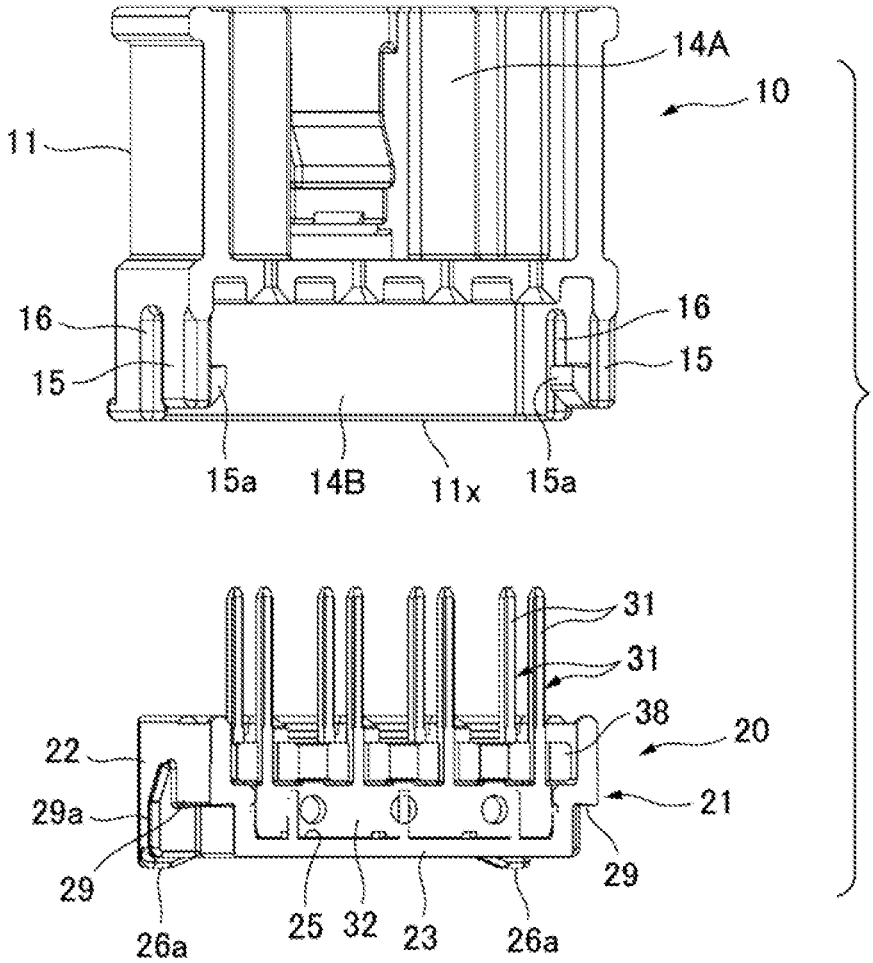
Figure 7B:
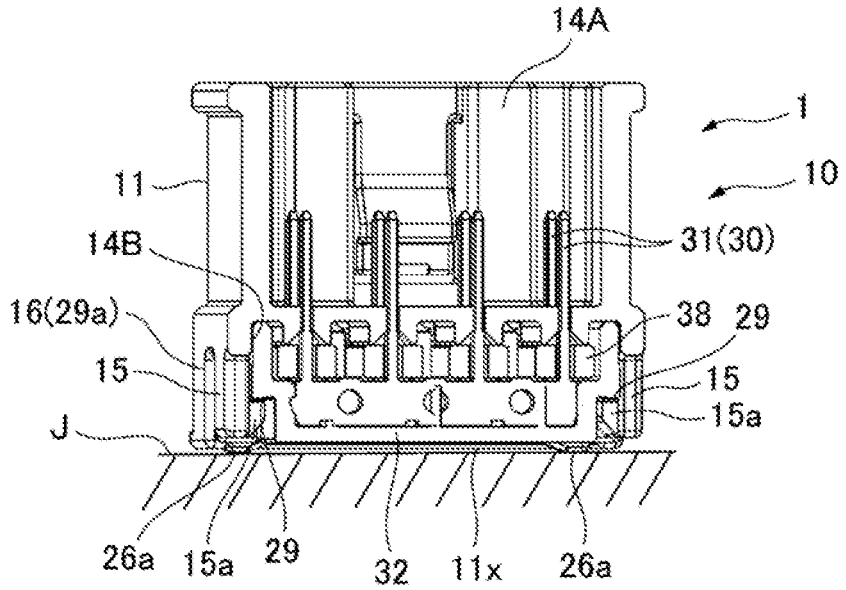

FIG. 1 illustrates a perspective view and an exploded perspective view of the joint connector according to the embodiment of the invention, as viewed from behind. FIG. 2 illustrates a perspective view and an exploded perspective view of a joint terminal unit that is a component of the joint connector, as viewed from the front. FIG. 3 illustrates a perspective view of the joint connector as viewed from the front, and a partial enlarged view thereof. FIG. 4 is a front view of the joint connector. FIG. 5 is a side view of the joint connector. FIGS. 6A and 6B are configuration diagrams of the joint connector, in which FIG. 6A is an exploded perspective view thereof, and FIG. 6B is a perspective view of the joint connector in an assembled state. FIGS. 7A and 7B are perspective views of the joint connector that is vertically cut, in which FIG. 7A is an exploded perspective view thereof, and FIG. 7B illustrates a perspective view of the joint connector in an assembled state and a state of the joint connector impacting on a floor surface in a case of dropping to the floor surface.

As illustrated in FIG. 1, a joint connector 1 includes a connector housing (also referred to as an "outer housing") 10 that is an integral molded product of resin, and a joint terminal unit 20 accommodated and held at an inner portion of the connector housing 10. As illustrated in FIG. 2, in the joint terminal unit 20, two joint terminals 30 are assembled to a terminal holder (also referred to as an "inner housing") 21 that is an integral molded product of resin, and a ferrite 38 is disposed for the joint terminal 30.

Here, the directionality in the following description will be described.

First, a term "axial direction" in the following description refers to a direction of engaging with a mating connector, that is, a direction in which an electrical contact portion (tab or pin) 31 of the joint terminal 30 extends (longitudinal direction). A "front side" refers to a side to be engaged with the mating connector CN, and a "rear side" refers to an opposite side thereof. With respect to an upper-lower direction and a left-right direction, "upper and lower" of the joint connector 1, which is disposed as illustrated in FIGS. 1 to 3, is referred to as an "upper-lower direction", and "left and right" of the joint connector 1, which is viewed from a front side or a rear side in this state, is referred to as a "left-right direction". Since the joint connector 1 has a symmetrical shape, the left and right are not distinguished here.

As illustrated in FIGS. 1, 6A, 6B, 7A and 7B, the joint terminal unit 20 is fitted and assembled to the inner portion of the connector housing 10 from a rear side of the connector housing 10. As illustrated in FIGS. 1 and 3, the connector housing 10 has a square cylinder-shaped outer peripheral wall 11 defining an inner space into which the joint terminal unit 20 is inserted. A bracket 12 for fixing to a stay or the like of a vehicle body is provided on a lower surface of the outer peripheral wall 11. As illustrated in the exploded views of FIGS. 1 and 3, the inner space defined by the outer peripheral wall 11 is partitioned into a front space 14A and a rear space 14B by a partition wall 13.

The partition wall 13 is provided as a panel wall perpendicular to the axial direction. The front space 14A located on a front side of the partition wall 13 constitutes a fitting hole into which a mating connector is fitted (hereinafter also referred to as "mating connector fitting hole 14A"). The rear space 14B (rear-end inner portion of the connector housing 10) located on a rear side of the partition wall 13 constitutes a fitting hole into which the terminal holder 21 of the joint terminal unit 20 is fitted (hereinafter also referred to as "joint terminal unit fitting hole 148").

When the terminal holder 21 of the joint terminal unit 20 is fitted into the rear space 14B, a pin-shaped electrical contact portion 31 of the joint terminal 30 protrudes into the front space 14A through a through-hole 18*a* provided in the partition wall 13. When a mating connector is fitted from a front side into the front space 14A, a terminal of the mating connector CN (also referred to as a mating terminal or an electric wire-side terminal) is brought into electrical contact with the electrical contact portion 31 of the joint terminal 30. Therefore, an inner portion of the mating connector fitting hole 14A corresponds to a "connection space". As illustrated in the exploded view of FIG. 1, the through-hole 18*a* of the partition wall 13 is provided in a terminal receiving portion 18 provided on a rear surface of the partition wall 13. The ferrite 38 of the joint terminal unit 20 is pressed against the terminal receiving portion 18.

As illustrated in FIG. 2, the terminal holder 21, which is a main component of the joint terminal unit 20, is in a square shape as viewed from the front, and is to be fitted into the rear space (joint terminal unit fitting hole) 14B in the connector housing 10. By fitting the terminal holder 21 into the fitting hole 14B at a rear end of the connector housing 10, a task that the joint terminal 30 is assembled to a proper position at the inner portion of the connector housing 10 is finished.

The terminal holder 21 has a peripheral wall 22 formed in an outer peripheral shape conforming to an inner peripheral shape of the joint terminal unit fitting hole 14B, and a rear wall 23 (see FIG. 1) located at a rear end portion on an inner peripheral side of the peripheral wall 22. A joint terminal holding groove 25 is provided on a front surface of the rear wall 23. An inner space 24 of the terminal holder 21 on a front side of the rear wall 23 is provided with a ferrite holding portion 28 partitioned by a partition rib 27 that is for partitioning and holding the ferrite 38. The peripheral wall 22 of the terminal holder 21 includes an upper surface wall 22*a*, a left and right side surface walls 22*b*, and a lower surface wall 22*c*, and each of the left and right side surface walls 22*b* is provided with a stepped locking portion 29 and a pair of guide ribs 29*a* that are located above and below the locking portion 29. The pair of guide ribs 29*a* are formed parallel to the axial direction.

As illustrated in FIG. 2, the joint terminal 30 is in a bus bar shape, and integrally has a plurality of pin-shaped electrical contact portions 31, each of which is shaped so as to be capable of contacting with the mating terminal (terminal of the mating connector CN) and which are arranged in a direction substantially perpendicular to the axial direction of the joint connector 1, and a short-circuiting portion 32 on a rear end side which extends in an arrangement direction of the electrical contact portions 31 and connects rear end portions of the electrical contact portions 31.

Two joint terminals 30 of the same configuration are assembled to the terminal holder 21 in a posture in which the electrical contact portions 31 are directed forward parallel to each other and in a state where the two short-circuiting portions 32 at the rear ends are accommodated respectively in two joint terminal holding grooves 25, of an upper section and a lower section, of the terminal holder 21. Each of the joint terminals 30 is held by the terminal holder 21 in a state where two electrical contact portions 31 of the two joint terminals 30, which are arranged vertically, are passed through two through-holes 38*a* of the ferrite 38 respectively.

A lock arm 15 is provided in left and right sidewalls (left and right sidewalls formed by left and right side surfaces 11*b*), of the peripheral wall (outer peripheral wall 11 of the connector housing 10) of the rear space (joint terminal unit fitting hole) 14B in the connector housing 10 into which the terminal holder 21 of the joint terminal unit 20 is fitted. The lock arms 15 of the left and right sidewalls are portions for locking the terminal holder 21 of the joint terminal unit 20 which is properly fitted into the joint terminal unit fitting hole 14B. A guide groove 16 is provided above and below each lock arm 15. The guide groove 16 is a groove by which the guide rib 29*a* of the terminal holder 21 is guided at the time of fitting the joint terminal unit 20 into the connector housing 10.

Since the pair of parallel guide grooves 16 are formed directing forward from a rearmost end edge 11*x* of the outer peripheral wall 11 of the connector housing 10, the lock arm 15 is connected to the outer peripheral wall 11 at a front end thereof, extends rearward in a cantilever manner and is elastically deformable outward. A lock beak 15*a* having a trapezoidal cross section, for example, is formed on an inner surface on a free end (rear end) side of the lock arm 15. At the time of fitting the terminal holder 21 into the joint terminal unit fitting hole 14B from a rear side, in a process of the fitting operation, the lock arm 15 is elastically deformed toward an outer side due to interference with the terminal holder 21 and recovers from the elastic deformation at a stage in which the lock beak 15*a* runs over the locking portion 29 of the terminal holder 21, and the lock beak 15*a* fits in a position on a rear side of the locking portion 29. Accordingly, the lock beak 15*a* is engaged with the locking portion 29, and locking of the lock arm 15 with respect to the terminal holder 21 is established.

When being engaged with the locking portion 29 of the terminal holder 21, the lock beak 15*a* of the lock arm 15 is located on the rear side of the locking portion 29 to restrict a position of the terminal holder 21 from being moved toward the rear side. Moreover, in this state, the terminal holder 21, for example, abuts against the partition wall 13 in the connector housing 10, and thereby the position thereof is restricted from moving forward. Therefore, the position of the terminal holder 21 is restricted so as not to rattle forward or backward.

However, in this state, for example, in a case where the joint connector 1 drops onto a floor surface with a rear end thereof facing downward and a large external force is applied to a rear end edge of the lock arm 15 and to the rearmost end edge 11*x* of the connector housing 10, a strong impact force acts on a lock portion (an abutting surface) between the lock beak 15*a* and the locking portion 29, and the lock portion and the lock arm 15 itself may be damaged. When the lock portion is damaged, an abnormality is caused in the assembled state of the joint terminal unit 20 with respect to the connector housing 10.

Therefore, in the joint connector 1, as a countermeasure, first, as illustrated in FIG. 5, the rear end edge (free end edge) of the lock arm 15 is retracted (toward the front side) to be forward than the rearmost end edge 11*x* of the connector housing 10. Further, as illustrated in FIG. 1, two rod-shaped ribs 26, of an upper section and a lower section, having a semicircular cross section extending in the left-right direction are provided on a rear end surface (rear end surface of the rear wall 23) of the terminal holder 21, and convex portions 26*a* protruding rearward are provided at both ends of each rib 26. Four convex portions 26*a*, of an upper one, a lower one, a left one and a right one, are located in the vicinity of the lock arm 15, and protrude rearward from the rearmost end edge 11*x* of the connector housing 10, as illustrated in FIG. 5, in a state where the terminal holder 21 is assembled to the connector housing 10.

Therefore, when the joint connector 1 drops with the rearmost end edge 11*x* side of the connector housing 10 facing downward and impacts onto a floor surface, the four convex portions 26*a* of the terminal holder 21 first come into contact with the floor surface. Further, in an appropriate assembled state with respect to the connector housing 10, the entire rear end edge of the joint terminal unit 20, excluding the convex portions 26*a*, is hidden on an inner side of the rearmost end edge 11*x* of the connector housing 10. As described, since the entire joint terminal unit 20, excluding the four convex portions 26*a*, is hidden in the connector housing 10, it can be easily determined visually that the joint terminal unit 20 is not halfway fitted to the connector housing 10.

Figure 9:
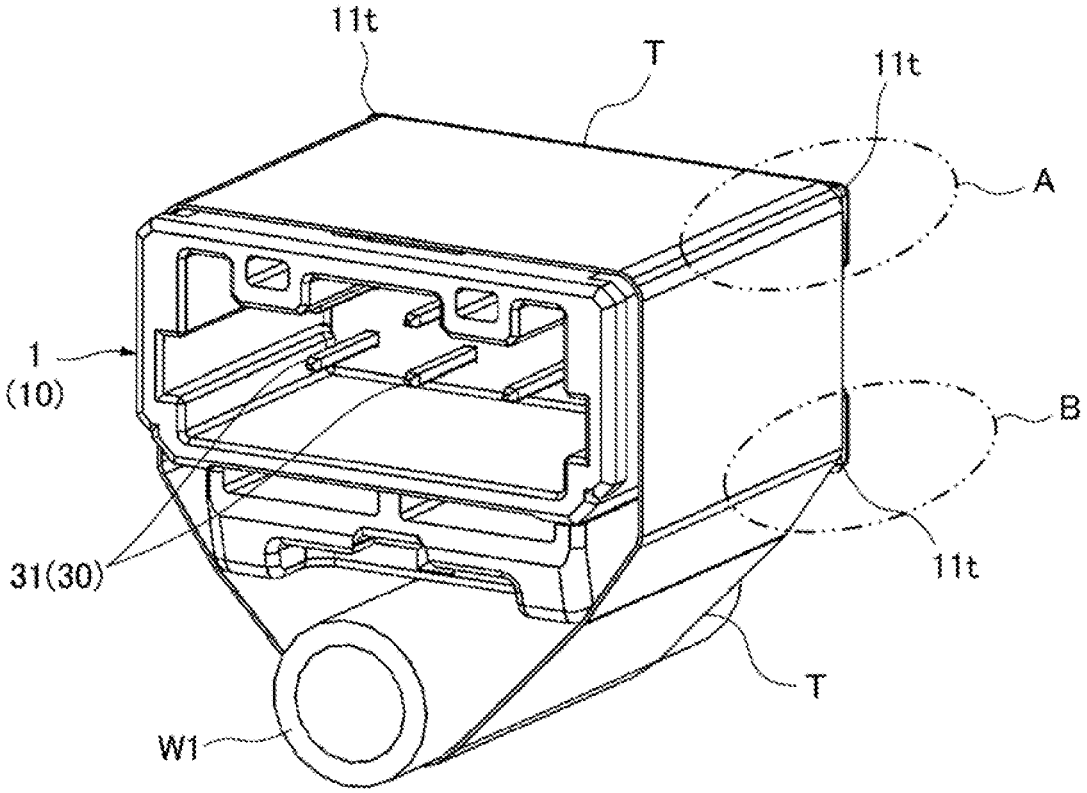
FIG. 9 is a perspective view of a joint connector in a state of being fixed to a wire harness main body (main line) by tape winding, as viewed from the front.
Figure 10:
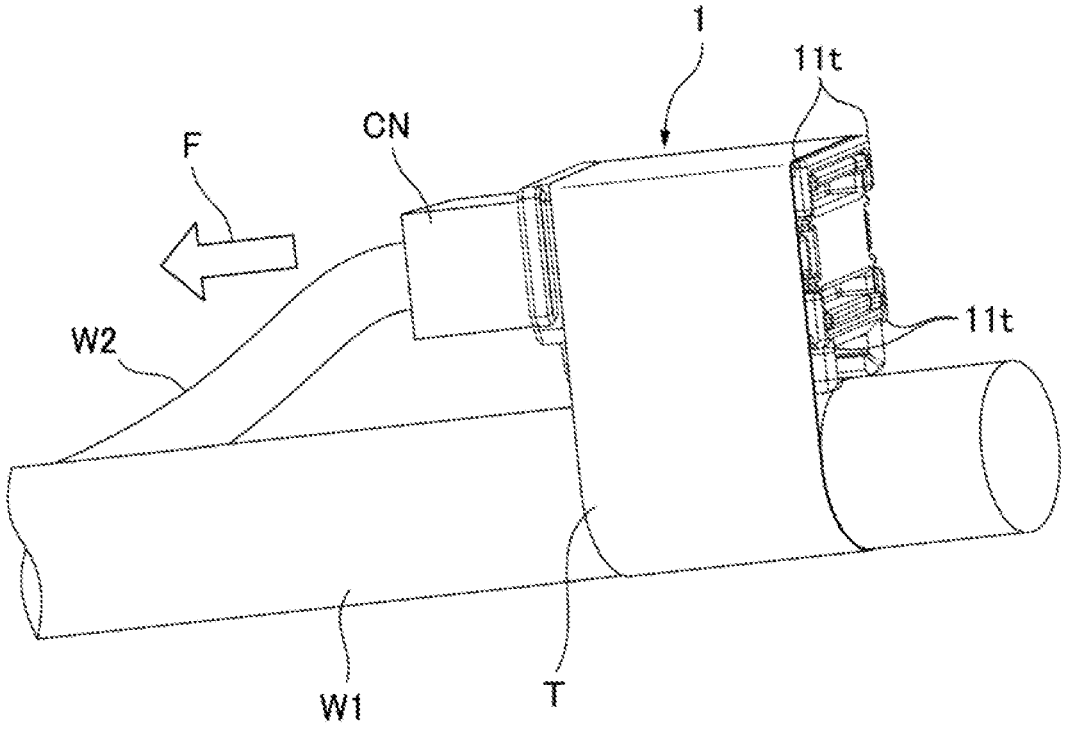
FIG. 10 is a schematic configuration diagram of a main part of a wire harness to which a joint connector is fixed by tape winding.

FIG. 9 is a perspective view of the joint connector 1 in a state of being fixed to a wire harness main body (main line) by tape winding, as viewed from the front. FIG. 10 is a schematic configuration diagram of a main part of a wire harness to which the joint connector 1 is fixed by tape winding.

As illustrated in FIGS. 9 and 10, in a using state, for example, the joint connector 1 is brought into contact with an outer peripheral surface of a main line (wire harness main body) W1 of the wire harness, in a posture in which the axial direction is directed in an extending direction of the main line of the wire harness, and in this state, may be fixed to the main line W1 of the wire harness by tape winding.

In this case, as illustrated in FIG. 9, tape T is wound around the outer peripheral wall 11 of the connector housing 10 along a circumferential direction. As illustrated in FIGS. 3, 4, and 5, an outermost surface of the outer peripheral wall 11 of the connector housing 10 is provided with the following structures. First, the outermost surface of the outer peripheral wall 11 is provided with a plurality of flat outer surfaces (an upper side surface 11*a*, the left and right side surfaces 11*b*, and a lower side surface 11*c*), which are flat surfaces along the axial direction and of which those adjoining each other in the circumferential direction intersect each other. Further, the outermost surface of the outer peripheral wall 11 is provided with a ridge line portion 11*r* along the axial direction, along which flat outer side surfaces (the upper side surface 11*a*, the left and right side surfaces 11*b*, and the lower side surface 11*c*) adjoining each other in the circumferential direction intersect each other. The ridge line portion 11*r* is provided with a chamfered portion 11*s*, which is obtained by removing a corner and whose width in the circumferential direction is less than those of the flat outer surfaces (the upper side surface 11*a*, the left and right side surfaces 11*b*, and the lower side surface 11*c*) on both sides thereof, and a non-chamfered portion 11*t* located at a rear end portion of the chamfered portion 11*s* in a ridge line direction. The non-chamfered portion 11*t* is a portion in which a corner is left without being chamfered. In FIG. 3, portions surrounded by two-dot chain lines A and B correspond to ridge line portions 11*r*.

The non-chamfered portion 11*t* protrudes outward from a surface of the chamfered portion 11*s*, and is on an inner side of an extension surface of the flat outer side surfaces (the upper side surface 11*a*, the left and right side surfaces 11*b*, and the lower side surface 11*c*) on both sides of the chamfered portion 11*s* or is on the extension surface (on the extension surface in this example). As illustrated in FIGS. 6A and 6B, the non-chamfered portion 11*t* serves as a portion for restricting positional deviation of the connector housing 10 with respect to the tape T in the axial direction, by engaging with a side edge of the tape T, which is wound around the outer side surface (the upper side surface 11*a*, the left and right side surfaces 11*b*, and the lower side surface 11*c*), at a position of the chamfered portion 11*s* when the tape is wound. That is, the chamfered portion 11*s* serves as a positional deviation restricting protrusion 11*t*. Hereinafter, the non-chamfered portion is referred to as the positional deviation restricting protrusion 11*t*.

In a case of assembling the joint connector 1, first, the joint terminal 30 and the ferrite 38 are assembled to the terminal holder 21 to form the joint terminal unit 20. Next, the joint terminal unit 20 is fitted into the joint terminal unit fitting hole 14B from the rear side of the connector housing 10. Then, for example, a front end of the terminal holder 21 abuts against a rear end of the partition wall 13 of the connector housing 10, and the position of the joint terminal unit 20 is restricted from moving forward. At the same time, the lock arm 15 engages with the locking portion 29 of the terminal holder 21 to establish the locking, and assembly of the joint connector 1 is completed. At this time, the guide rib 29*a* of the terminal holder 21 is guided into the guide groove 16 of the connector housing 10. In this state, the pin-shaped electrical contact portion 31 of the joint terminal 30 passes through the partition wall 13 of the connector housing 10 and projects into the front space 14A. As described above, the four convex portions 26*a* provided on the rear wall 23 of the terminal holder 21 protrude rearward from the rearmost end edge 11*x* of the connector housing 10 (see FIG. 5).

Accordingly, in a case where the joint connector 1 drops to a floor surface with the rear end side thereof facing downward when being handled independently, the impact force first acts on the terminal holder 21 instead of the connector housing 10. This impact force is transmitted to the connector housing 10 via the convex portions at the front end of the terminal holder 21, and it is possible to prevent a strong impact from acting on an engaging portion between the lock arm 15 and the locking portion 29, and is possible to prevent damage. This will be described in detail with reference to the schematic diagram of FIGS. 8A and 8B.

Figure 8A:
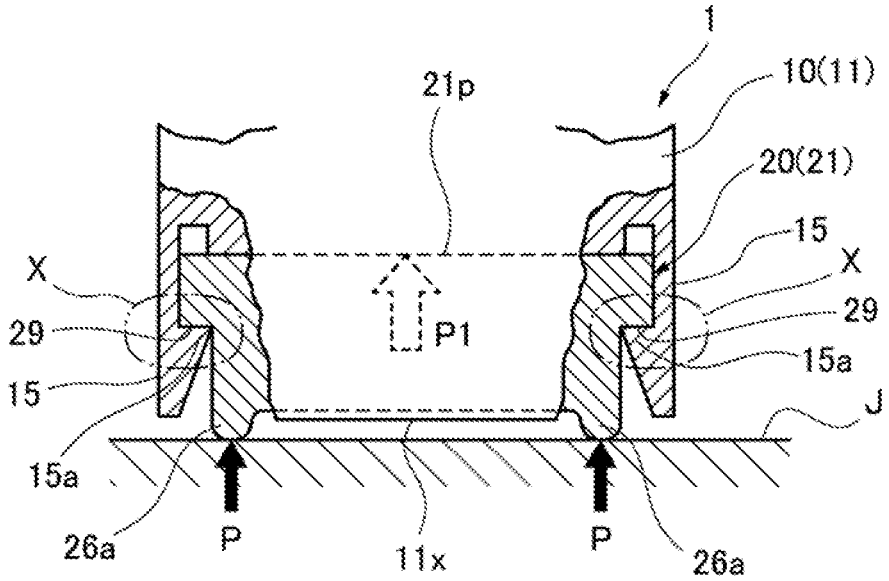
Figure 8B:
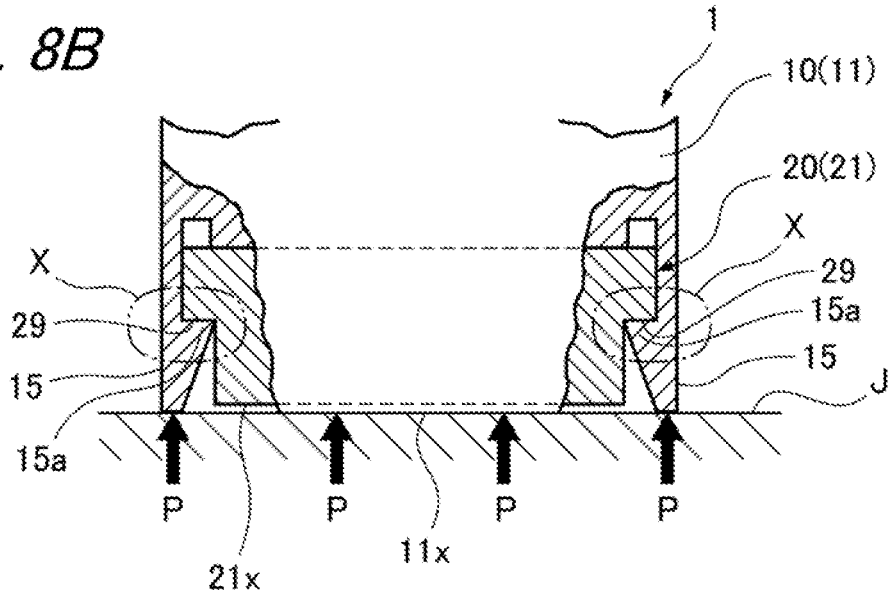

FIGS. 8A and 8B are diagrams schematically illustrating a position at which an impact transmits when the joint connector 1 drops onto a floor surface J with the rear end side thereof facing downward, in which FIG. 8A is a diagram illustrating a state where a load from the floor surface is applied to the convex portions 26*a* at the time of dropping in a case of the joint connector according to the embodiment, and FIG. 8B is a diagram illustrating a state where the load from the floor surface is applied at the time of dropping in a case of a joint connector having no convex portion.

As illustrated in FIG. 8A, when the joint connector 1 drops with the rear end side thereof facing downward to impact on floor surface J, what first comes into contact with the floor surface J is not the rearmost end edge 11*x* of the connector housing 10 having the lock arm 15, but the convex portions 26*a* provided on the rear end surface of the terminal holder 21. Therefore, the impact of dropping (external force P received from the floor surface J) is first applied to the terminal holder 21, and then is transmitted to the connector housing 10 via an abutting surface 21*p* of the terminal holder 21 (this force is indicated by an arrow P1). Here, since the lock beak 15*a* of the lock arm 15 provided in the connector housing 10 is engaged with the locking portion 29 at the position on the rear side (lower side in FIG. 8) of the locking portion 29 of the terminal holder 21, an action in a direction in which a surface pressure is reduced, instead of an action in a direction in which the surface pressure is increased, is exerted on the abutting surface (portion indicated by a two-dot chain line circle X) between the lock beak 15*a* and the locking portion 29. Therefore, an excessive load does not act on the lock portion (the portion indicated by the two-dot chain line circle X), damage of the lock arm 15 can be avoided, and the possibility that the assembled state is not normal due to the damage of the lock arm 15 is eliminated.

In contrast, as illustrated in FIG. 8B, when there is no convex portion 26*a*, the impact force P from the floor surface J is directly applied to the connector housing 10. Therefore, the load acts as a force in a direction in which the surface pressure is increased, and is exerted on the abutting surface (a portion indicated by a two-dot chain line circle X) between the lock beak 15*a* of the lock arm 15 and the locking portion 29 of the terminal holder 21. Therefore, an excessive load acts on the lock portion (the portion indicated by the two-dot chain line circle X), and there is a high possibility that the lock arm 15 is damaged. When the lock arm 15 is damaged, the assembly state may not be normal.

In this respect, since the joint connector 1 of the present embodiment is provided with the convex portions 26*a* on the rear end surface of the terminal holder 21, which protrude rearward than the rearmost end edge 11*x* of the connector housing 10, the lock arm 15 can be protected from the impact at the time of dropping.

It is also conceivable to attach a rear cover to the rear end portion of the joint connector so that the impact at the time of dropping is not applied to the lock arm. This will be briefly described with reference to the comparative examples of FIGS. 14A, 14B, 15A and 15B.

Figure 14A:
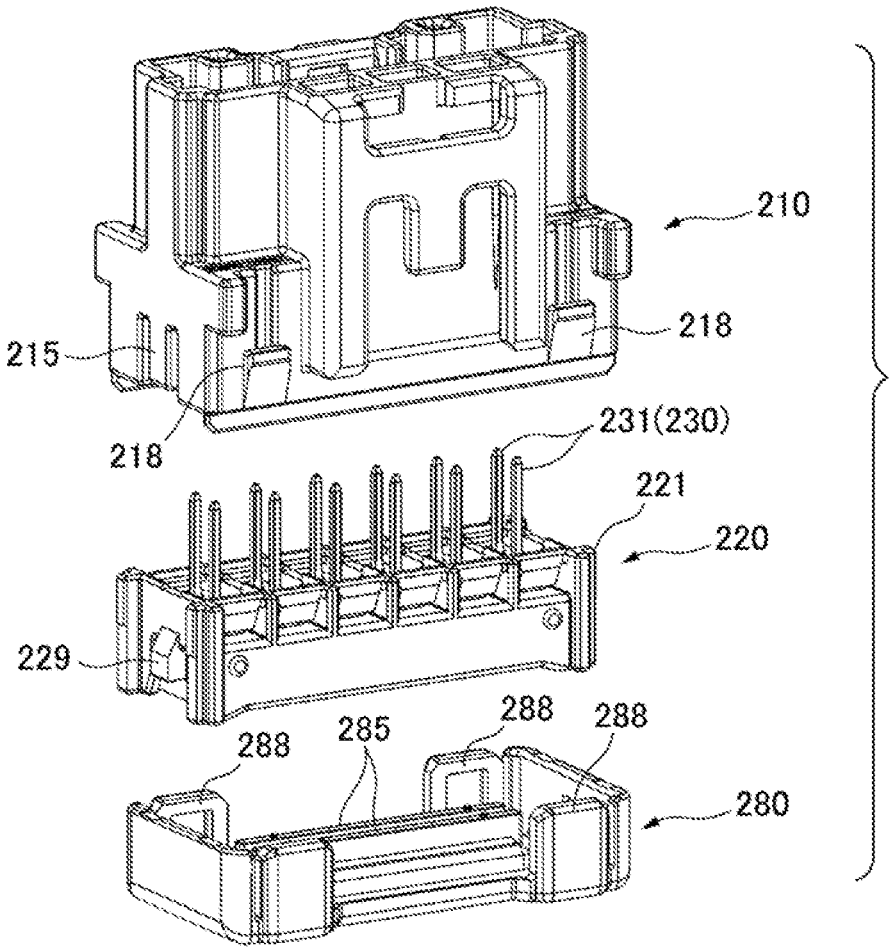
Figure 14B:
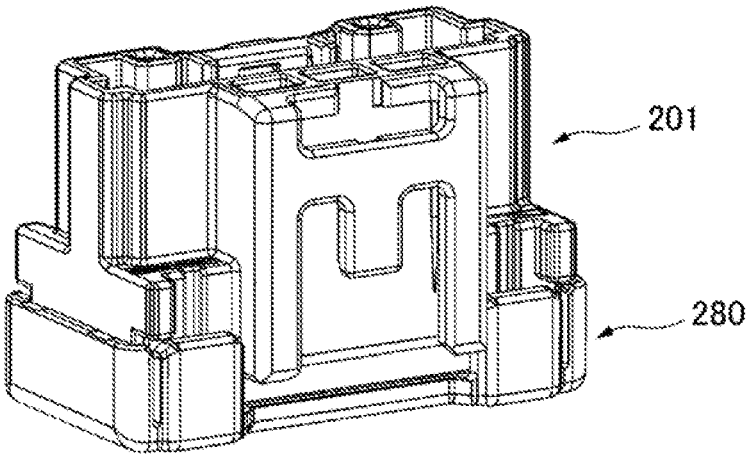
Figure 15A:
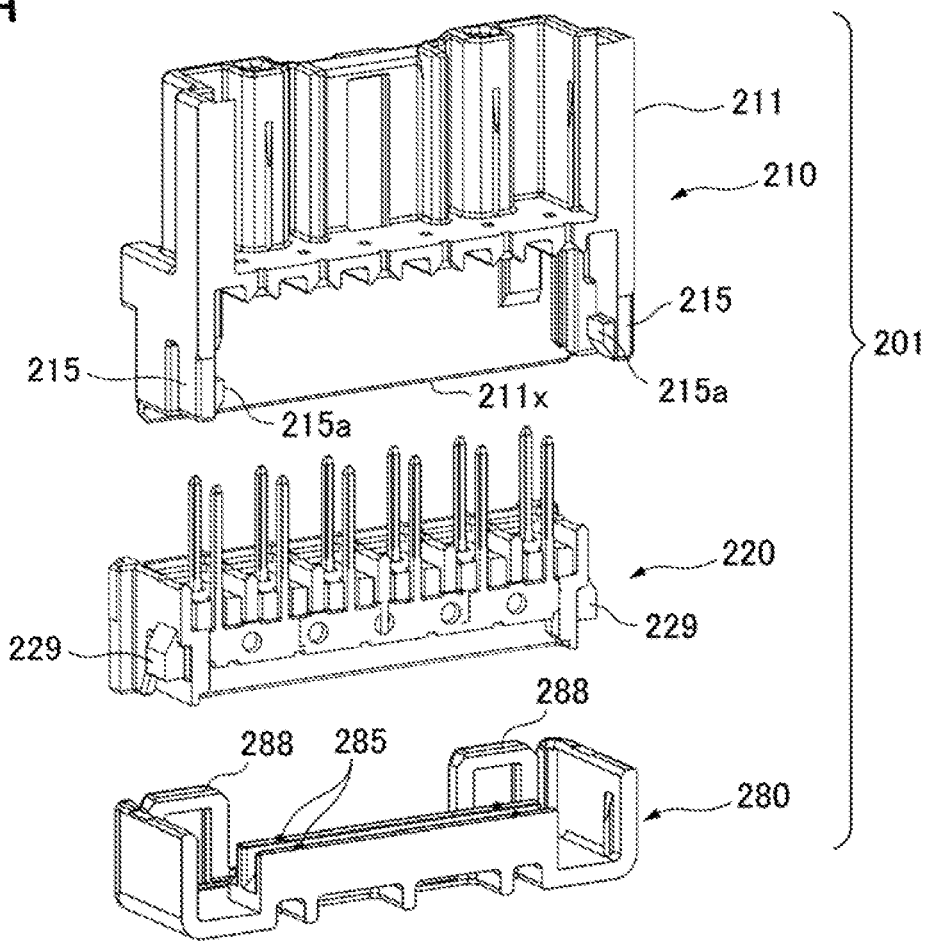
Figure 15B:
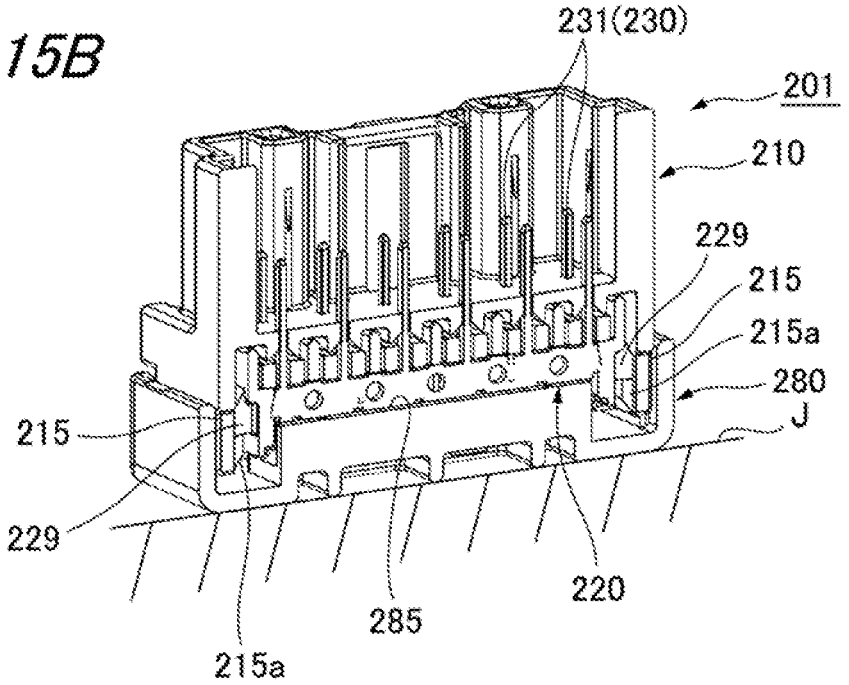
Figure 16:
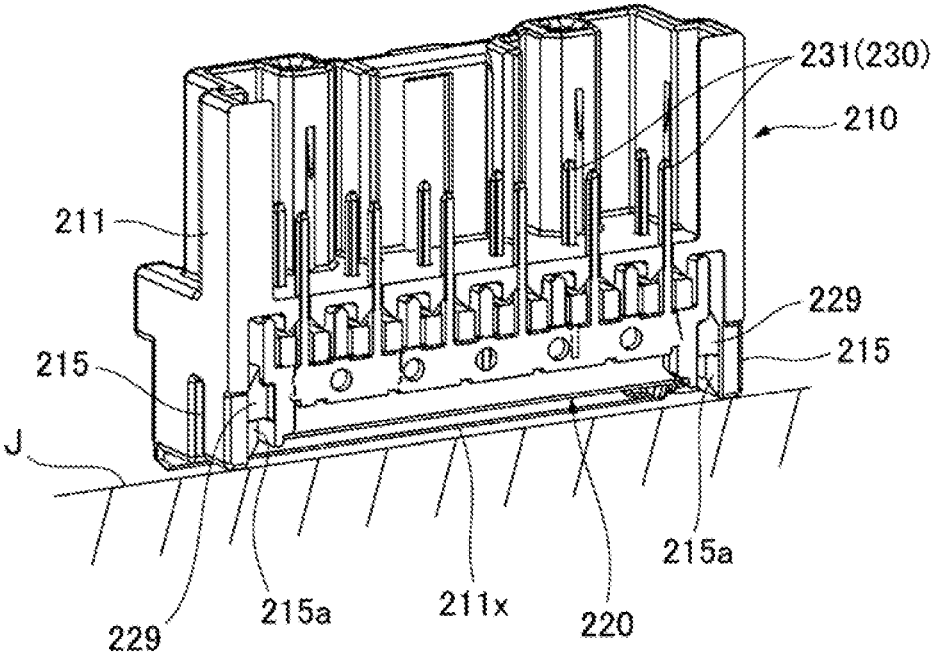
FIG. 16 is a perspective view of the joint connector illustrated in FIGS. 14A and 14B which is cut vertically and whose rear cover is removed, and illustrates a state of the joint connector impacting on a floor surface in a case of dropping to the floor surface.

FIGS. 14A and 14B are diagrams illustrating a configuration of a joint connector (a type with a rear cover) serving as a comparative example with respect to the joint connector 1 according to the embodiment, in which FIG. 14A is an exploded perspective view thereof, and FIG. 14B is a perspective view of the joint connector in an assembled state. FIGS. 15A and 15B are perspective view of the joint connector illustrated in FIGS. 14A and 14B which are vertically cut, in which FIG. 15A is an exploded perspective view thereof, and FIG. 15B illustrates a perspective views of the joint connector in an assembled state and a state of the joint connector impacting on a floor surface in a case of dropping to the floor surface. FIG. 16 is a perspective view of the joint connector illustrated in FIGS. 14A and 14B which is cut vertically and whose rear cover is removed, and illustrates a state of the joint connector impacting on a floor surface in a case of dropping to the floor surface.

A joint connector 201 of the comparative example illustrated in FIGS. 14A to 16 includes a connector housing 210, a joint terminal unit 220, and a rear cover 280. In a rear end portion of an outer peripheral wall 211 of the connector housing 210, a cantilevered lock arm 215 having a lock beak 215*a* is provided on an inner side surface thereof. A lock portion 218 for locking the rear cover 280 is provided on another sidewall portion of the outer peripheral wall of the connector housing 210.

The joint terminal unit 220 includes a terminal holder 221 and a joint terminal 230 assembled to the terminal holder 221. The joint terminal 230 is provided with an electrical contact portion 231. A locking portion 229 is provided on an outer side surface of the terminal holder 221. The configuration so far is substantially the same as that of the joint connector 1 of the present embodiment, except that the connector housing 210 is provided with the lock portion 218 for a rear cover. However, in the joint connector 201 of the comparative example, there is no convex portion provided on a rear end surface of the terminal holder 221. The rear cover 280 is provided as a component having a function of compensating for that.

The rear cover 280 is assembled to a rear end of the connector housing 210 after the joint terminal unit 220 is fitted to the connector housing 210 from a rear side, and includes a lock piece 288 that engages with the lock portion 218 of the connector housing 210. In an inner portion of the rear cover 280, there is provided an abutting portion 285 that abuts against the rear end surface of the terminal holder 221 in an assembled state.

Even in a case where the joint connector 201 of the comparative example in which the rear cover 280 is provided as described above drops to the floor surface J with a rear end side thereof facing downward, as illustrated in FIG. 15B, the rear cover 280 impacts on the floor surface J. An impact force received from the floor surface J is transmitted to the joint terminal unit 220 (terminal holder 221) via the abutting portion 285 of the rear cover 280. Therefore, an excessive impact force can be prevented from being generated on an abutting surface between the lock arm 215 and the locking portion 229, and the lock arm 215 can be protected. That is, the same effect as that of the joint connector 1 of the present embodiment can be obtained.

However, in this case, an extra component (rear cover 280) is added, which hinders reduction in size and weight. Here, as illustrated in FIG. 16, the impact of dropping is directly applied to the connector housing 210 when the rear cover 280 is not provided, and thus an excessive load acts on the lock arm 215 and the lock arm 215 may be damaged.

As described above, according to the joint connector 1 of the embodiment, the lock arm 15 can be protected without using an extra component such as the rear cover 280. Therefore, it is possible to avoid an increase in the number of components and to contribute to the reduction in size and weight.

Further, according to the joint connector 1 of the embodiment, since the convex portions 26*a* that first impact on the floor surface are disposed at positions near the four corners of the rectangular rear end surface of the terminal holder 21, that is, at positions in the vicinity of the lock arms 15, the lock arms 15 can be protected from the impact more reliably by the convex portions 26*a*. In addition, since the convex portions 26*a* are formed only at specific positions, the increase in size and weight can also be minimized.

Next, a case where the joint connector 1 is used will be described.

As illustrated in FIG. 10, in a case where a plurality of electric wires of a branch line W2 branched from the wire harness main body (main line) W1 formed of a plurality of electric wires are caused to be short-circuited, the joint connector is used. In this case, the mating connector CN (hereinafter referred to as the electric wire-side connector CN) is attached to an end portion of the branch line W2 in advance. An electric wire-side terminal (mating terminal) attached to a terminal of each electric wire of the branch line W2 is accommodated in the electric wire-side connector CN.

Next, the joint connector 1 is brought into contact with the outer peripheral surface of the wire harness main body W1 in a posture in which the axial direction is directed in a direction along which the wire harness main body (main line) W1 extends. The joint connector 1 is directed such that the front connector fitting hole is in a direction facing the electric wire-side connector CN of the branch line W2. Further, as illustrated in FIG. 9, the tape T is wound around the joint connector 1 and the wire harness main body W1 to fix the joint connector 1 to the wire harness main body W1. At any timing, the electric wire-side connector CN is fitted into the connector fitting hole of the joint connector 1. Accordingly, it is possible to obtain a wire harness in which a predetermined plurality of electric wires of the branch line W2 are short-circuited with the joint connector 1.

In the fixed state by tape winding as described, according to the joint connector 1, the positional deviation of the joint connector 1 with respect to the tape T and the wire harness main body W1 can be prevented by the positional deviation restricting protrusion 11*t* provided in the outer peripheral wall 11 of the connector housing 10. That is, in this using state, an external force may act on the joint connector 1 in a direction indicated by an arrow F in FIG. 10, but even when such an external force acts thereon to move the joint connector 1 in the direction of the arrow F, the positional deviation restricting protrusion 11*t* of the joint connector 1 is caught on the side edge of the tape T as illustrated by two-dot chain line circles A and B in FIG. 9. Therefore, the positional deviation of the joint connector 1 can be prevented.

In particular, in the joint connector 1, the ridge line portion 11*r* along the axial direction, along which the outer side surfaces (the upper side surface 11*a*, the right and left side surfaces 11*b*, and the lower side surface 11*c*) of the connector housing 10 intersect, is provided with the chamfered portion 11*s* obtained by having a corner thereof removed and the non-chamfered portion 11*t* that is intentionally left without being chamfered. The non-chamfered portion 11*t* located at a rear end of the chamfered portion 11*s* in a ridge line direction serves as a positional deviation restricting protrusion of the connector housing 10 with respect to the wound tape T. The positional deviation restricting protrusion 11*t* is formed of the non-chamfered portion and protrudes outward from the surface of the chamfered portion 11*s*. Therefore, the positional deviation of the connector housing 10 with respect to the tape T wound at the position of the chamfered portion 11*s* can be prevented. Further, the positional deviation restricting protrusion 11*t* formed of the non-chamfered portion is on the inner side of the extension surface of the flat outer side surfaces (the upper side surface 11*a*, the left and right side surfaces 11*b*, and the lower side surface 11*c*) on both sides of the chamfered portion 11*s* or is on the extension surface. That is, the positional deviation restricting protrusion 11*t* at least does not protrude to an outer side of the flat outer surfaces (the upper side surface 11*a*, the left and right side surfaces 11*b*, and the lower side surface 11*c*).

Therefore, it is possible to eliminate a protrusion protruding from the outer surface of the connector housing 10, and accordingly it is possible to prevent an increase in an outermost form and an increase in weight of the joint connector 1, and moreover, it is possible to prevent damage due to catching during handling.

The convex portion 26*a* is formed by raising an end portion of the rib 26 into a single protrusion in the embodiment described above, and alternatively may be formed as a hemispherical protrusion. Further, the convex portion 26*a* may be provided as a linear protrusion strip or a frame-shaped protrusion strip (both are like ribs), instead of an independent protrusion. Alternatively, as a convex portion, an entire area of the rear end surface of the terminal holder 21 may protrude rearward from the rearmost end edge 11*x* of the connector housing 10.

Figure 11:
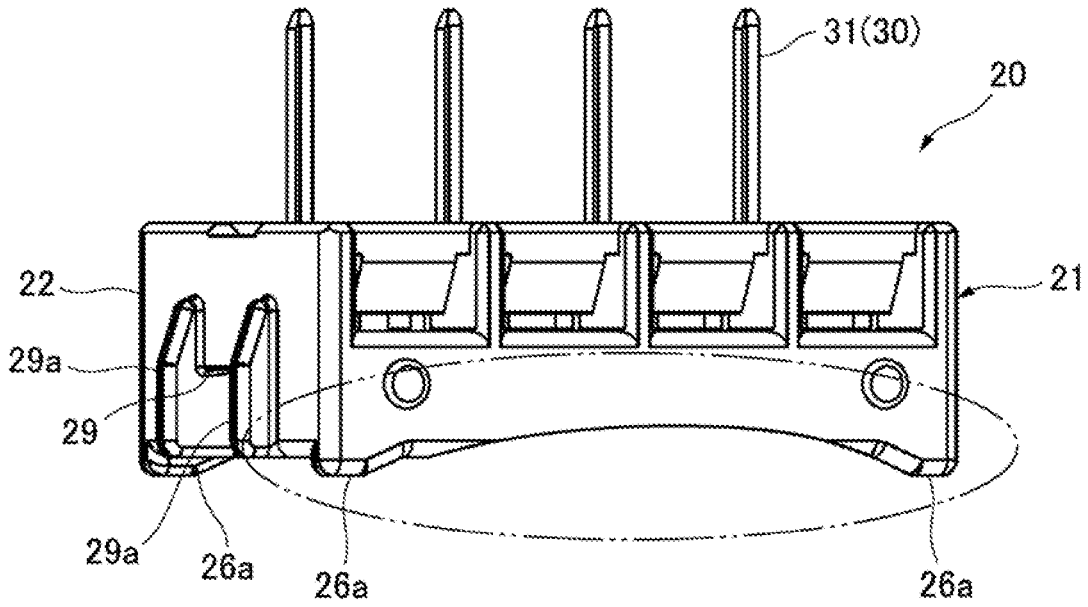
FIG. 11 is a perspective view of a joint terminal unit of a joint connector according to another embodiment of the invention, as viewed from a side.
Figure 12:
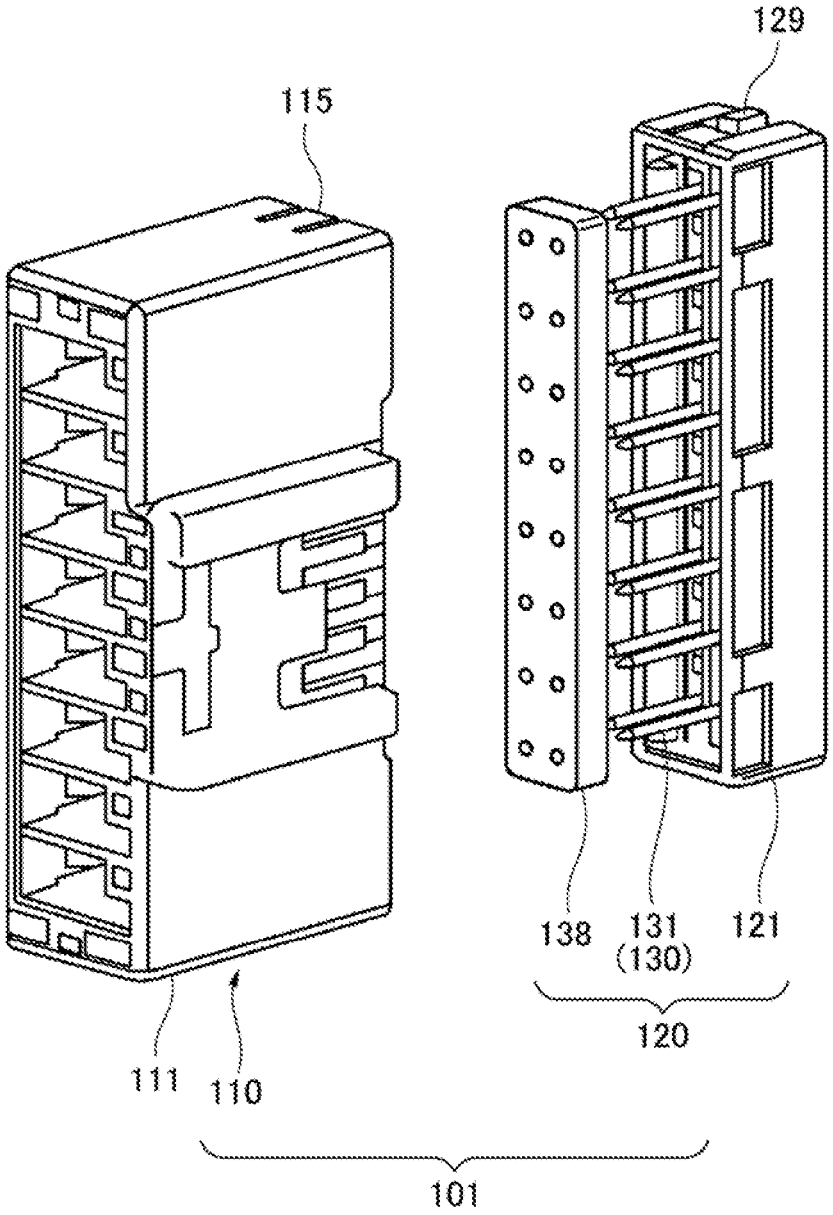
FIG. 12 is an exploded perspective view of a joint connector in the related art.
Figure 13:
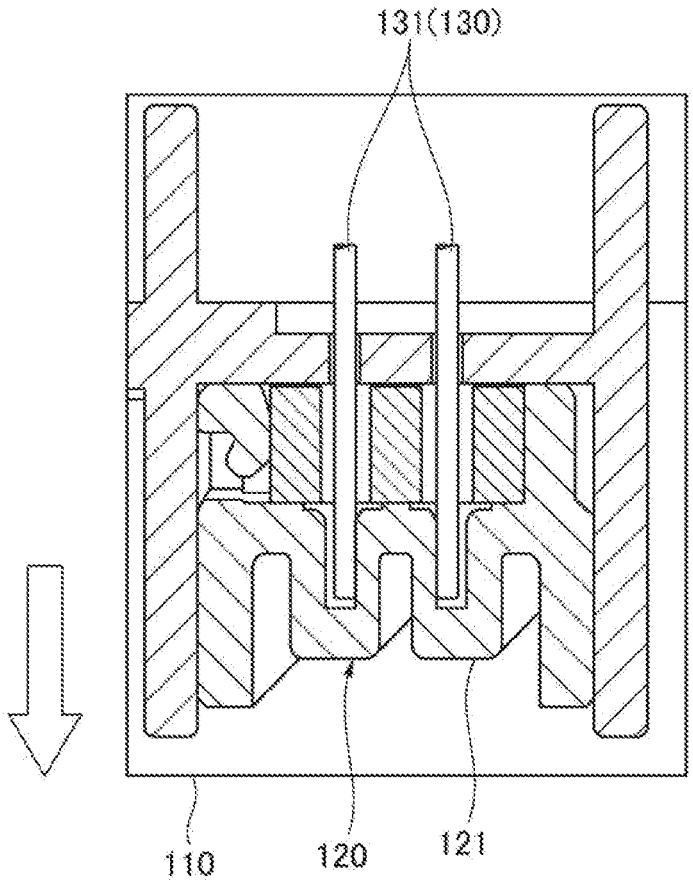
FIG. 13 is a cross-sectional view of the joint connector in FIG. 12.

As illustrated in FIG. 11, the rectangular rear end surface of the terminal holder 21 is formed in a concave shape, recessed in an arch shape in a side view (a portion indicated by a two-dot chain line in the drawing), and the convex portions 26*a* may be disposed at four corners of the concave-shaped rear end surface. Also in this case, the increase in the size and weight can be minimized and the lock arm 15 can be protected from the impact. Further, since the convex portion 26*a* is continuous in the concave shape, stress (external force) due to the impact of dropping can be dispersed and the convex portion 26*a* itself can be prevented from being damaged.

Here, characteristics of the joint connector according to the embodiment of the invention described above will be briefly summarized in the following [1] to [3].

[1] A joint connector (1), including: a connector housing (10) in which an inner space at a front portion thereof in an axial direction is secured as a connection space (14A) with a mating terminal;

a joint terminal (30) that is accommodated in an inner portion of the connector housing (10), and that locates an electrical contact portion (31) to be connected with the mating terminal in the connection space (14A);

a terminal holder (21) that is fitted into a rear-end inner portion (14B) of the connector housing (10) while holding the joint terminal (30); and a lock arm (15) that is formed in an outer peripheral wall (11) of the connector housing (10), and engages with a locking portion (29) provided on the terminal holder (21) when the terminal holder (21) is properly fitted into the rear-end inner portion (14B) of the connector housing (10), to lock the terminal holder (21) with respect to the connector housing (10), in which the lock arm (15) is connected to the outer peripheral wall (11) of the connector housing (10) at a front end thereof and extends rearward in a cantilever manner, and includes a lock beak (15*a*) on an inner side surface of a free end thereof, and when the terminal holder (21) is fitted into the rear-end inner portion (14B) of the connector housing (10) the lock beak (15*a*) fits in a position on a rear side of the locking portion (29), locking with respect to the locking portion (29) is established, and a rear end portion of the terminal holder (21) is provided with convex portions (26*a*) that protrude rearward from a rearmost end edge (11*x*) of the connector housing (10) in a proper assembled state of the terminal holder (21) with respect to the connector housing (10).

[2] The joint connector (1) according to [1], in which a pair of the lock arms (15) are provided on side wall portions (11*b*) facing each other of the outer peripheral wall (11) of the connector housing (10) having a rectangular shape in a rear view, and the convex portions (26*a*) are respectively disposed at positions near four corners of a rectangular rear end surface of the terminal holder (21), that is, at positions in the vicinity of the lock arms (15).

[3] The joint connector according to [2], in which the rectangular rear end surface of the terminal holder (21) is formed in a concave shape, recessed in an arch shape in a side view, and the convex portions (26*a*) are disposed at the four corners of the concave-shaped rear end surface respectively.

What is claimed is:

1. A joint connector, comprising:

a connector housing in which an inner space at a front portion thereof in an axial direction is secured as a connection space with a mating terminal;

a joint terminal that is accommodated in an inner portion of the connector housing, and that locates an electrical contact portion to be connected with the mating terminal in the connection space;

a terminal holder that is fitted into a rear-end inner portion of the connector housing while holding the joint terminal; and a lock arm that is formed in an outer peripheral wall of the connector housing, and engages with a locking portion provided on the terminal holder when the terminal holder is properly fitted into the rear-end inner portion of the connector housing, to lock the terminal holder with respect to the connector housing, wherein the lock arm is connected to the outer peripheral wall of the connector housing at a front end thereof and extends rearward in a cantilever manner, and includes a lock beak on an inner side surface of a free end thereof, and when the terminal holder is fitted into the rear-end inner portion of the connector housing, the lock beak fits in a position on a rear side of the locking portion, and locking with respect to the locking portion is established, and a rear end portion of the terminal holder is provided with convex portions that are arranged between the locking portion and another locking portion, opposite to the locking portion across the terminal holder, and protrude rearward from a rearmost end edge of the connector housing in a proper assembled state of the terminal holder with respect to the connector housing.

2. The joint connector according to claim 1, wherein a pair of the lock arms are provided on side wall portions facing each other of the outer peripheral wall of the connector housing having a rectangular shape in a rear view, and the convex portions are respectively disposed at positions near four corners of a rectangular rear end surface of the terminal holder, that is, at positions in the vicinity of the lock arms.

3. The joint connector according to claim 2, wherein the rectangular rear end surface of the terminal holder is formed in a concave shape, recessed in an arch shape in a side view, and the convex portions are disposed at the four corners of the concave-shaped rear end surface respectively.

* * * * *